US008763800B2

(12) United States Patent
Agirbas

(10) Patent No.: US 8,763,800 B2
(45) Date of Patent: Jul. 1, 2014

(54) CIGARETTE PACKET WITH A HOLLOW SPACE

(75) Inventor: Erdinc Agirbas, Bayreuth (DE)

(73) Assignee: British American Tobacco (Germany) GmbH, Hamburg (DE)

( * ) Notice: Subject to any disclaimer, the term of this patent is extended or adjusted under 35 U.S.C. 154(b) by 0 days.

(21) Appl. No.: 13/820,112

(22) PCT Filed: Jul. 28, 2011

(86) PCT No.: PCT/EP2011/062965

§ 371 (c)(1),
(2), (4) Date: Feb. 28, 2013

(87) PCT Pub. No.: WO2012/028395

PCT Pub. Date: Mar. 8, 2012

(65) Prior Publication Data

US 2013/0153449 A1 Jun. 20, 2013

(30) Foreign Application Priority Data

Aug. 31, 2010 (DE) ..... 10 2010 035 938

(51) Int. Cl.
*B65D 85/10* (2006.01)

(52) U.S. Cl.
USPC ..... 206/256

(58) Field of Classification Search
USPC ..... 206/252, 253, 256, 257, 258, 271, 273; 229/87.13
See application file for complete search history.

(56) References Cited

U.S. PATENT DOCUMENTS

| | | | | |
|---|---|---|---|---|
| 4,850,482 | A * | 7/1989 | Campbell | 206/273 |
| 5,439,105 | A * | 8/1995 | Focke | 206/268 |
| 5,570,779 | A * | 11/1996 | Draucker et al. | 206/246 |
| 7,383,950 | B1 * | 6/2008 | Roberts et al. | 206/256 |
| 2006/0213789 | A1 * | 9/2006 | Ghini et al. | 206/268 |

FOREIGN PATENT DOCUMENTS

| | | | |
|---|---|---|---|
| GB | 456438 | A | 8/1935 |
| WO | 2005/014436 | A1 | 2/2005 |

OTHER PUBLICATIONS

International Search Report and Written Opinion, mailed Sep. 14, 2011, for PCT/EP2011/062965, filed Jul. 28, 2011.

* cited by examiner

*Primary Examiner* — Jacob K Ackun
(74) *Attorney, Agent, or Firm* — N W Poulsen; L A Pinol

(57) ABSTRACT

The invention relates to a packet for smoking products comprising a front area, a rear area and two opposing lateral areas, wherein a hollow space is formed on at least one lateral area in the interior space of the packet bounded by these areas and extends between the lateral area and the smoking product accommodating space.

15 Claims, 7 Drawing Sheets

CIGARETTE PACKET WITH A HOLLOW SPACE

CLAIM FOR PRIORITY

Figure 1:
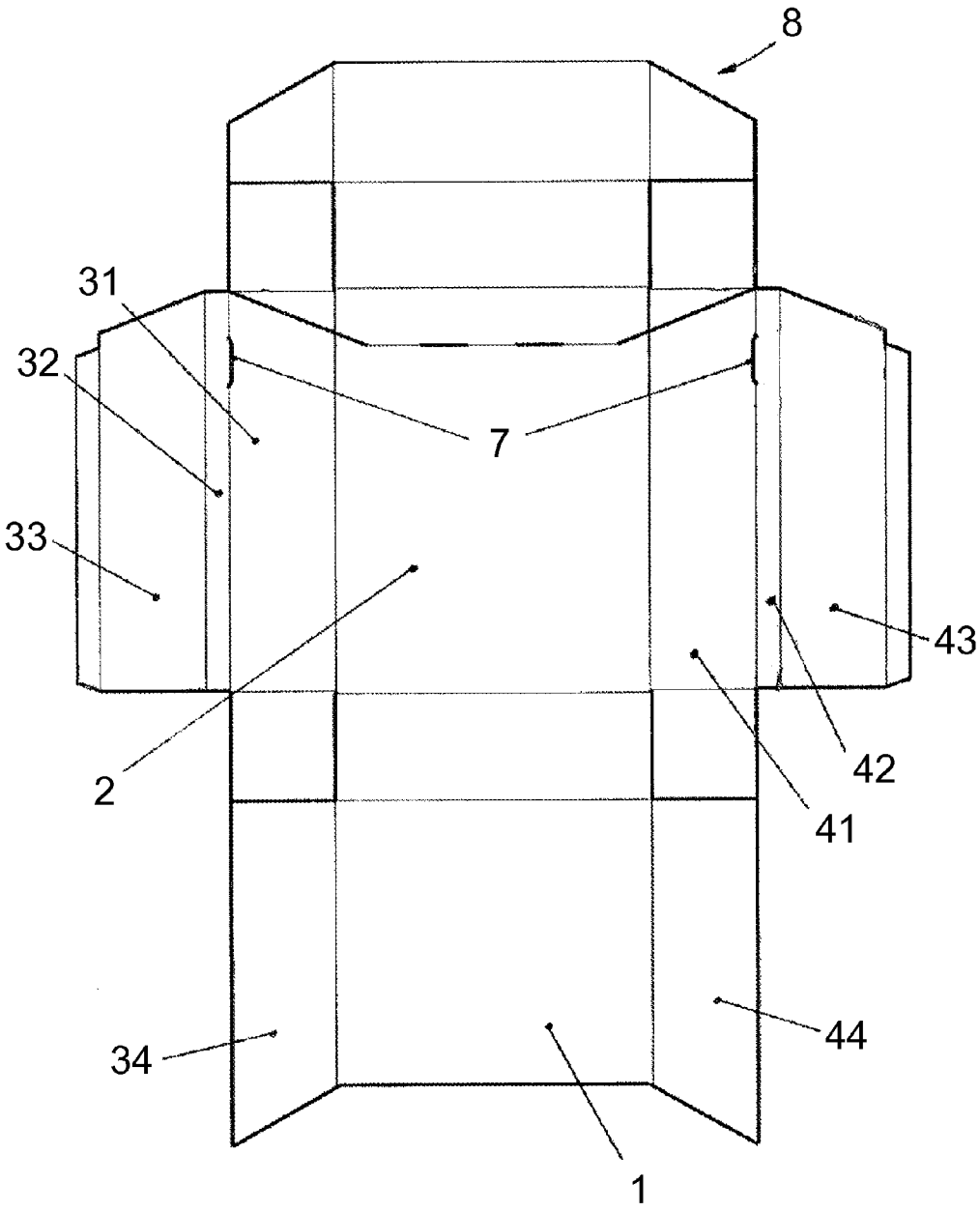

This application is a National Stage Entry entitled to and hereby claims priority under 35 U.S.C. §§365 and 371 to corresponding PCT Application No. PCT/EP2011/062965, filed Jul. 28, 2011, which in turn claims priority to DE Application No. 10 2010 035 938.6, filed Aug. 31, 2010. The entire contents of the aforementioned applications are herein expressly incorporated by reference.

The invention relates to a packet for smoking products, in particular for cigarettes, in which a hollow space is formed on at least one lateral area of the packet in the interior space of the packet and extends between the lateral area and the smoking product accommodating space.

When packing smoking products, in particular cigarettes, the packing machines which are used are set to a particular format for the packets to be filled. If the number of cigarettes to be packed in each packet or the format of the cigarettes—for example, the diameter of the individual cigarettes—changes, then the format of the packet has to be adapted to the changed parameters. The cigarettes would otherwise no longer be fixedly enclosed by the packet and would be situated relatively loosely in the packet. This can cause the quality of the cigarettes to be impaired, in particular if the packet is exposed to jolting.

If, however, a cigarette packet is manufactured which fixedly encloses a smaller number of cigarettes or cigarettes of another format, its exterior dimensions also automatically change. In this case, the entire packing machine has to be switched to a new format, which is very time-consuming and cost-intensive. Although the present invention is described in the following in connection with cigarette packets, it is equally conceivable to apply it to packets for other smoking products.

The present invention is based on the object of packing a number of cigarettes which deviates from the standard value and/or cigarettes which deviate from the standard format, without having to switch the entire packing machine to a new packet format.

This object is solved by the subject of patent claim 1, wherein the sub-claims define preferred embodiments of the present invention.

The packet in accordance with the invention comprises a front area, a rear area and two opposing lateral areas, wherein a hollow space is formed on at least one lateral area in the interior space of the packet bounded by these areas and extends between the lateral area and the smoking product accommodating space.

The terms "lateral", "front", "rear", "top" and "bottom" as used in the following are to be understood as for a typical cigarette packet. When the packet is in an upright position, the lid is arranged at the top of the packet and hinged on the rear side of the packet. Correspondingly, the front side is the side which lies opposite the rear side and mostly points towards the user, wherein the lateral sides extend in the vertical direction between the front and rear side of the packet.

In other words, the smoking product accommodating space does not occupy the entire interior space of the packet as bounded by the front area, the rear area and the two opposing areas and also does not extend over the entire extent of the lateral areas up to the lateral areas, since a hollow space is formed at least at a partial region of at least one lateral area.

Such a hollow space can then be an "open" hollow space, i.e. a space which is not enclosed by areas on all sides, i.e. which is in particular not separated from the accommodating space at at least one point due to a "missing" area. Preferably, however, the hollow space is separated off from the smoking product accommodating space by areas from all sides.

Providing at least one hollow space in the interior space of the packet reduces the volume of the accommodating space, such that a smaller number of cigarettes and/or cigarettes of another format can be fixedly enclosed by a packet with unaltered exterior dimensions. In this way, it is no longer necessary to switch the entire packing machine to a new format, but rather only the parts which collect the cigarettes into a block of cigarettes by means of aluminium or paper film.

The hollow space can be bounded by invariable areas and so exhibit a fixed volume. One preferred embodiment of the present invention, however, provides a significant advantage in that at least one area of the cigarette packet which bounds the hollow space is not arranged fixedly in the cigarette packet but can rather be altered in terms of its position and/or alignment. In particular, an area which separates the hollow space off from the accommodating space can be configured to be pivotable, thus enabling the volume of the hollow space to be varied within predetermined limits. This means that a cigarette packet configured in this way can accommodate a differing number of cigarettes and/or differing cigarette formats within particular limits, without having to alter the blank of the cigarette packet and/or hollow space, since the hollow space is then simply adapted to the different formats of the block of cigarettes, wherein the block of cigarettes is nonetheless still fixedly enclosed from all sides by the packet. It would also be conceivable to fix an area, which had previously been variable in terms of its position and/or alignment, by adhesion. In this way, the same blank of a packet can be used to manufacture packets with accommodating spaces of different sizes which are bounded by fixed areas.

In accordance with another preferred embodiment of the present invention, the hollow space extends over the entire height of the lateral area. Since conventional cigarette packets comprise a packet body which accommodates the cigarettes and a lid which can be flipped and is arranged at the top of the packet body, the expression "lateral area" can also be understood to mean only a lateral area of the packet body, i.e. "over the entire height of the lateral area" then means that the hollow space extends over the entire height of the lateral area of the packet body, i.e. in a conventional cigarette packet, from the base of the packet body to the upper edge of the packet body on which the lid is lying. This creates a complete, smaller interior pocket, and the block of cigarettes is fixedly enclosed from all sides and over its entire height. It is equally conceivable for the hollow space and/or the areas which bound the hollow space to extend beyond the packet body, for example into the lid.

In another preferred embodiment, the hollow space extends substantially over the entire width of the lateral area. If it simultaneously extends over the entire length of the lateral area, then the accommodating space no longer reaches as far as the corresponding lateral area of the packet at any point, such that there may be said to be a double wall over the depth of the packet, i.e. between the front and rear area of the packet, on the corresponding lateral area of the packet.

In one specific case, the hollow space can exhibit a rectangular cross-section, although any expedient shapes which can be formed on a side area of a cigarette packet are conceivable for the hollow space. Triangular and quadrilateral cross-sections in particular may be mentioned in this respect, wherein the cross-section for the hollow space can also exhibit more than four corners. Curved areas would also be conceivable for delimiting the hollow space.

In one preferred embodiment of the present invention, hollow spaces are formed on both lateral areas and extend between the respective lateral area and the accommodating space. The hollow spaces on both sides can also be symmetrical with respect to each other. An area symmetry or axial symmetry in the cross-section of the packet is in particular conceivable in this respect.

In accordance with a particularly preferred embodiment, the hollow space is bounded by areas which are part of a single-piece blank of the packet. In other words, the hollow space is thus formed by areas of a packet blank which are part of the packet body itself. Such a packet body is usually manufactured from a planar material, in particular card, which is folded and glued at particular points in order to form a packet.

In the packet blank, the areas which bound the hollow space can be arranged laterally adjacent to the rear area of the packet. This is to be understood to mean that the areas are arranged adjacent to and/or are level with the rear area of the packet as viewed in the direction of the longitudinal axis of the blank. The longitudinal axis of the blank corresponds to the vertical axis of the completely folded and glued packet and—providing the packet is one with hollow spaces which are symmetrically formed on the side areas on both sides—can be an axis of symmetry of the packet blank. However, any position of the areas which bound the hollow space and/or spaces is conceivable in the blank, as long as they are arranged on the side areas and within the interior space of the packet in the completely folded and glued packet.

In accordance with another preferred embodiment of the present invention, at least one but preferably all of the areas which bound the hollow space extend(s) beyond an upper edge of the area of the blank which lies on the outside of the lateral area of the packet. In other words, at least one but preferably all of the areas which bound the hollow space is/are longer than the area in the blank which ultimately forms the exterior area on the side area of the packet. Since the lower edge of the lateral areas of the packet lid lies on the upper edge of the exterior side area, the longer areas which bound the hollow space create the impression that they extend out of the packet body, in the direction of the packet lid, beyond the upper edge of the side areas of the packet. In this way, these areas can additionally be used to guide the packet lid during opening and closing and to hold it in a closed position—a function accorded the packet frame in conventional cigarette packets.

In this sense, it is possible in one preferred embodiment to form a protrusion on at least one of the areas which bound the hollow space, wherein said protrusion projects slightly from the corresponding area, thus coming to rest on a corresponding interior area of the lid when the lid is closed, and holds the lid in a closed position by way of a frictional fit. This protrusion is preferably formed on a folding edge between two of the areas, as is already known from conventional packet frames.

Preferred embodiments of the present invention are described in more detail on the basis of enclosed FIGS. 1 to 5. The invention can comprise any of the features disclosed here, individually and in any expedient combination.

Figure 2A:
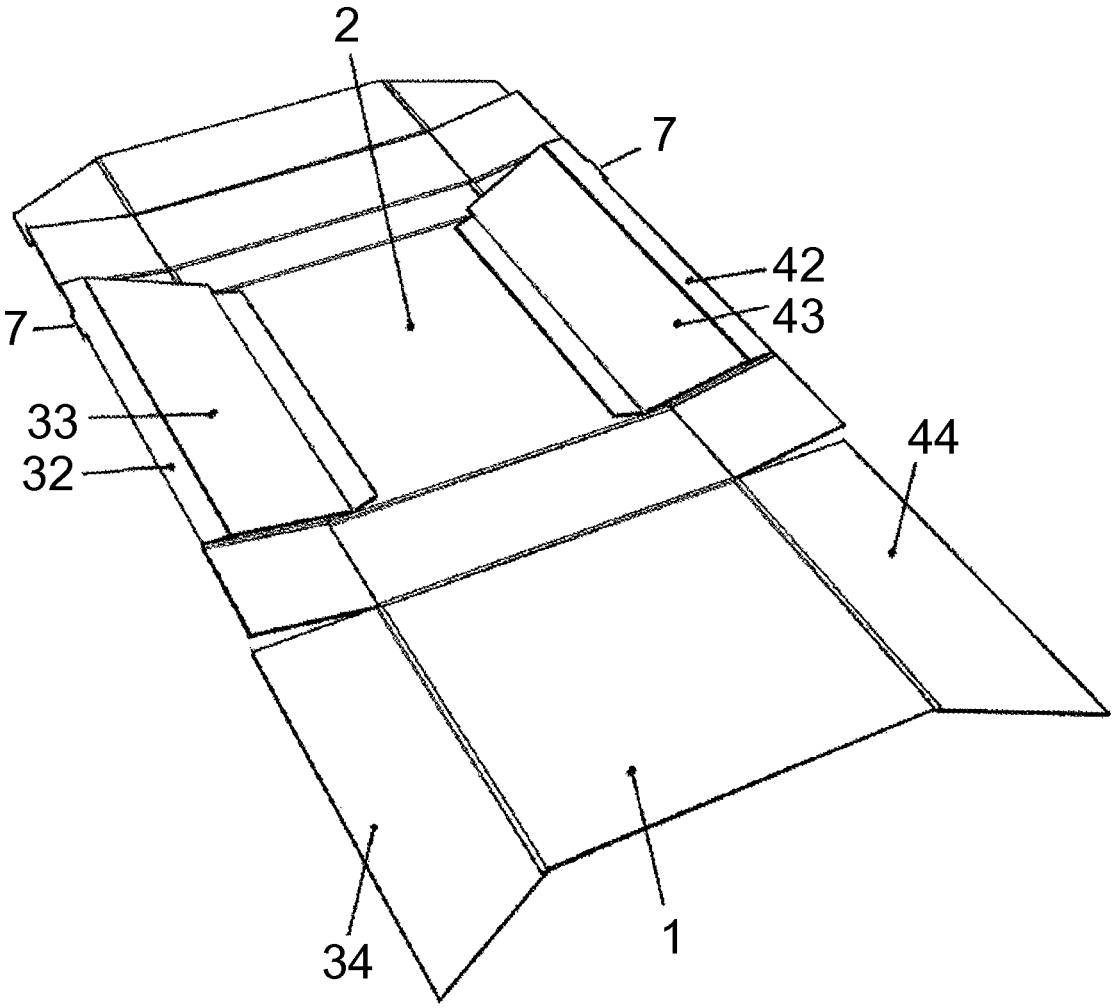
Figure 2B:
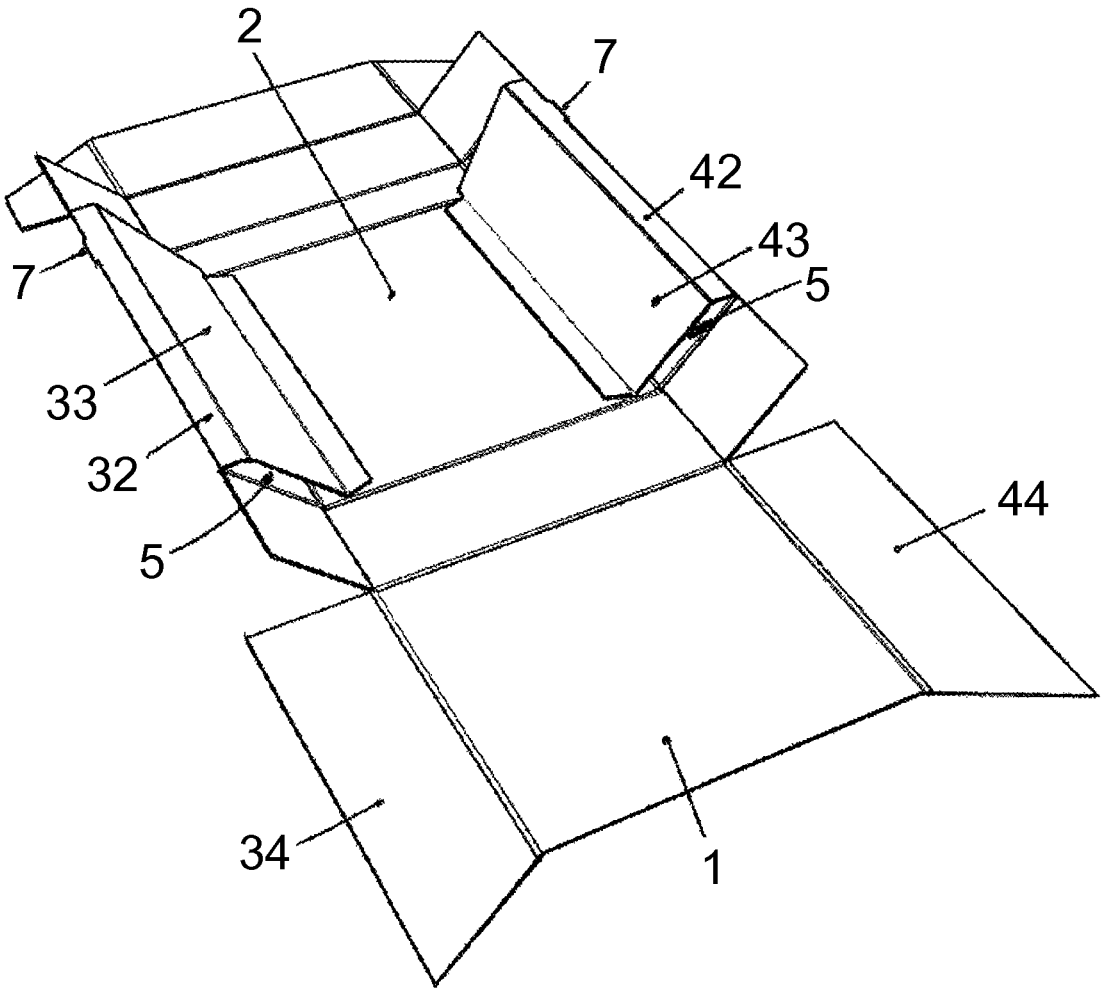
Figure 2C:
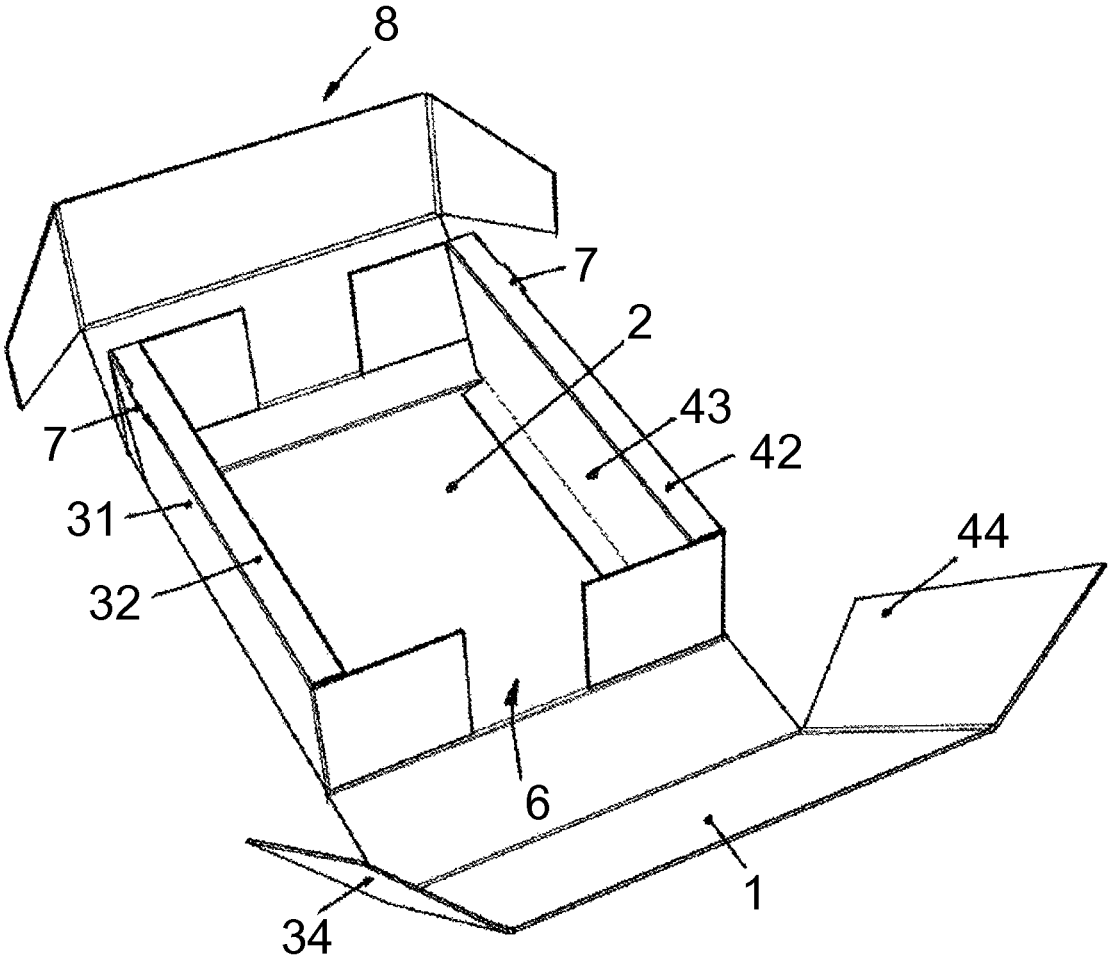
Figure 3:
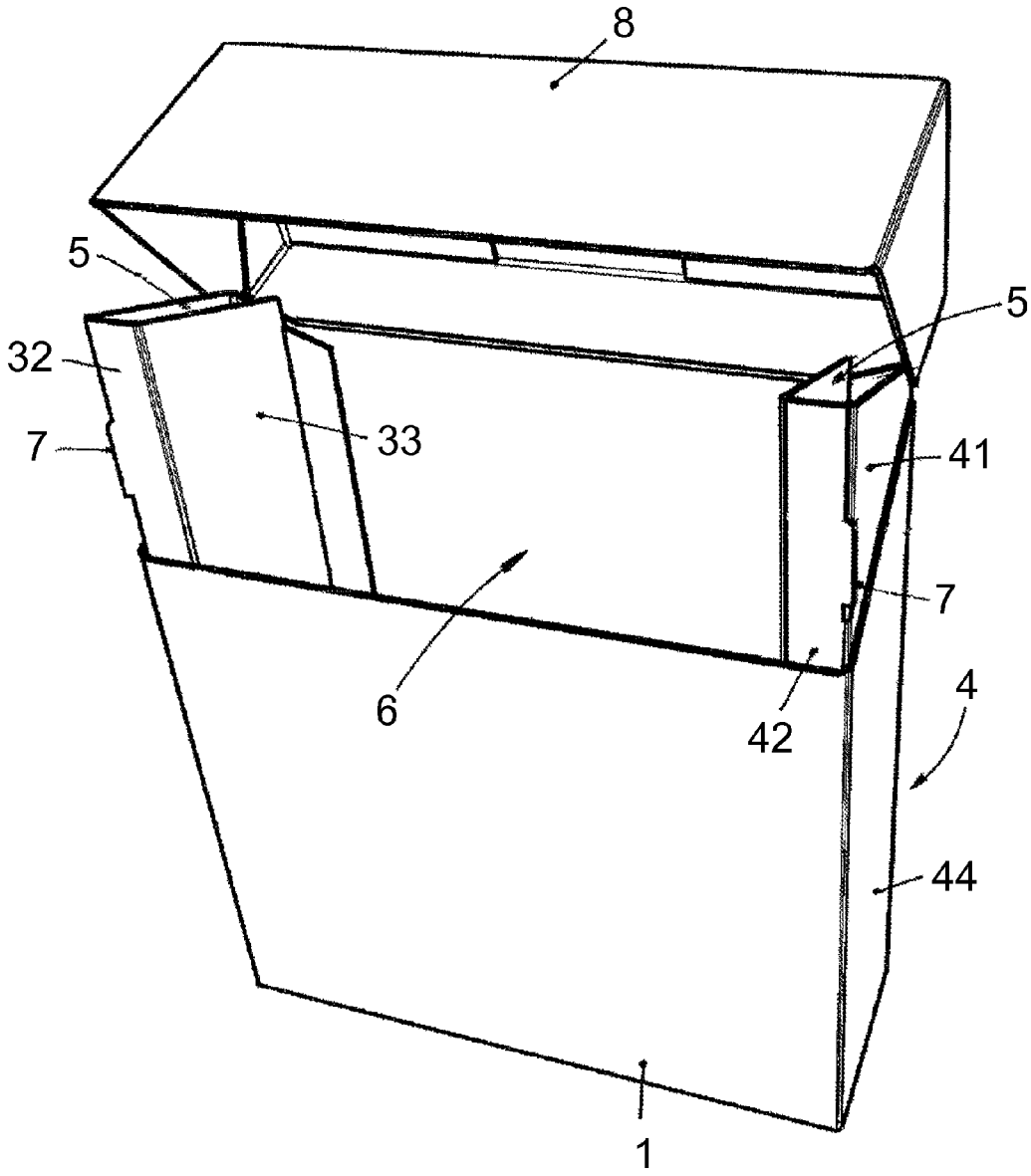
Figure 4:
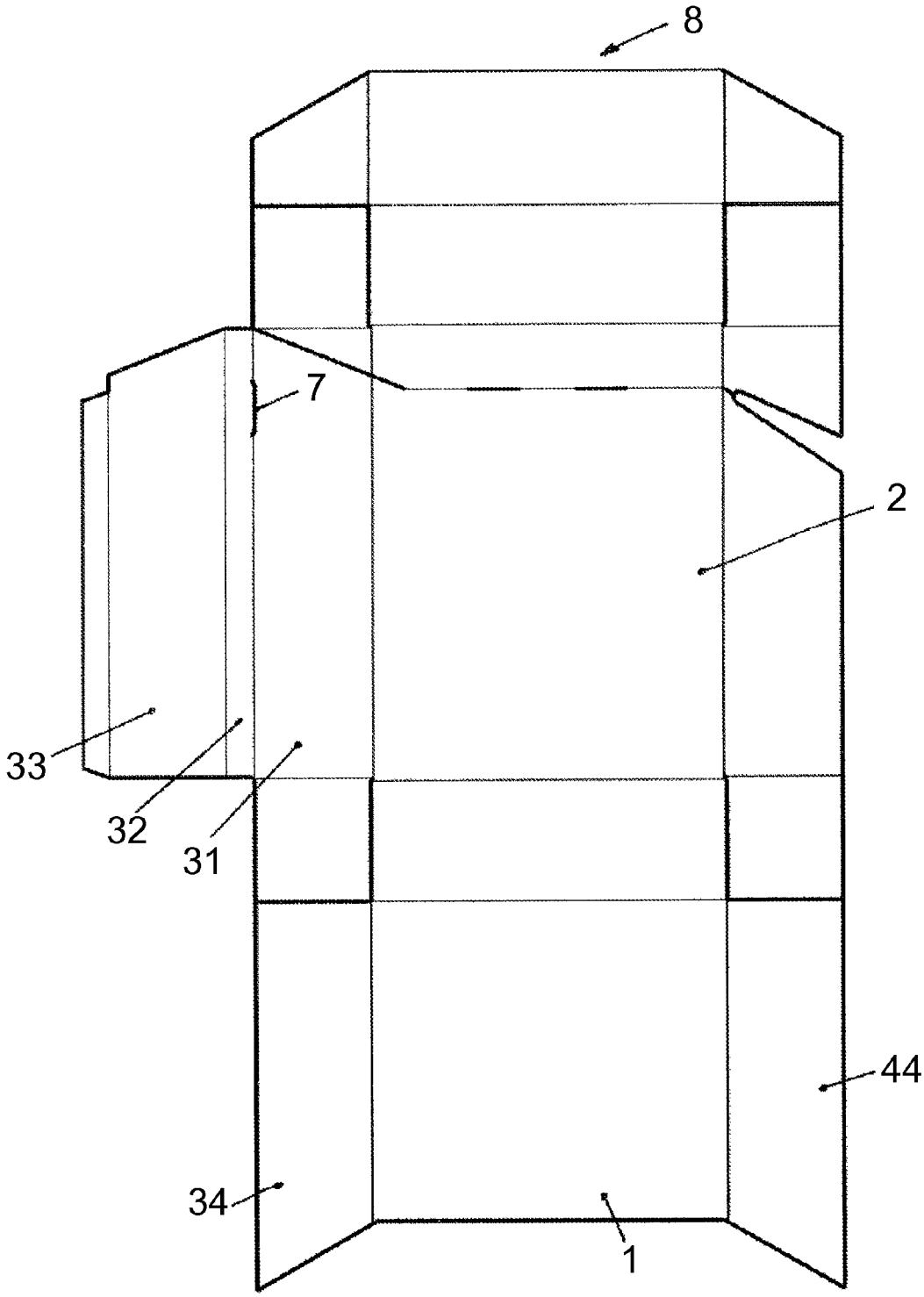
Figure 5:
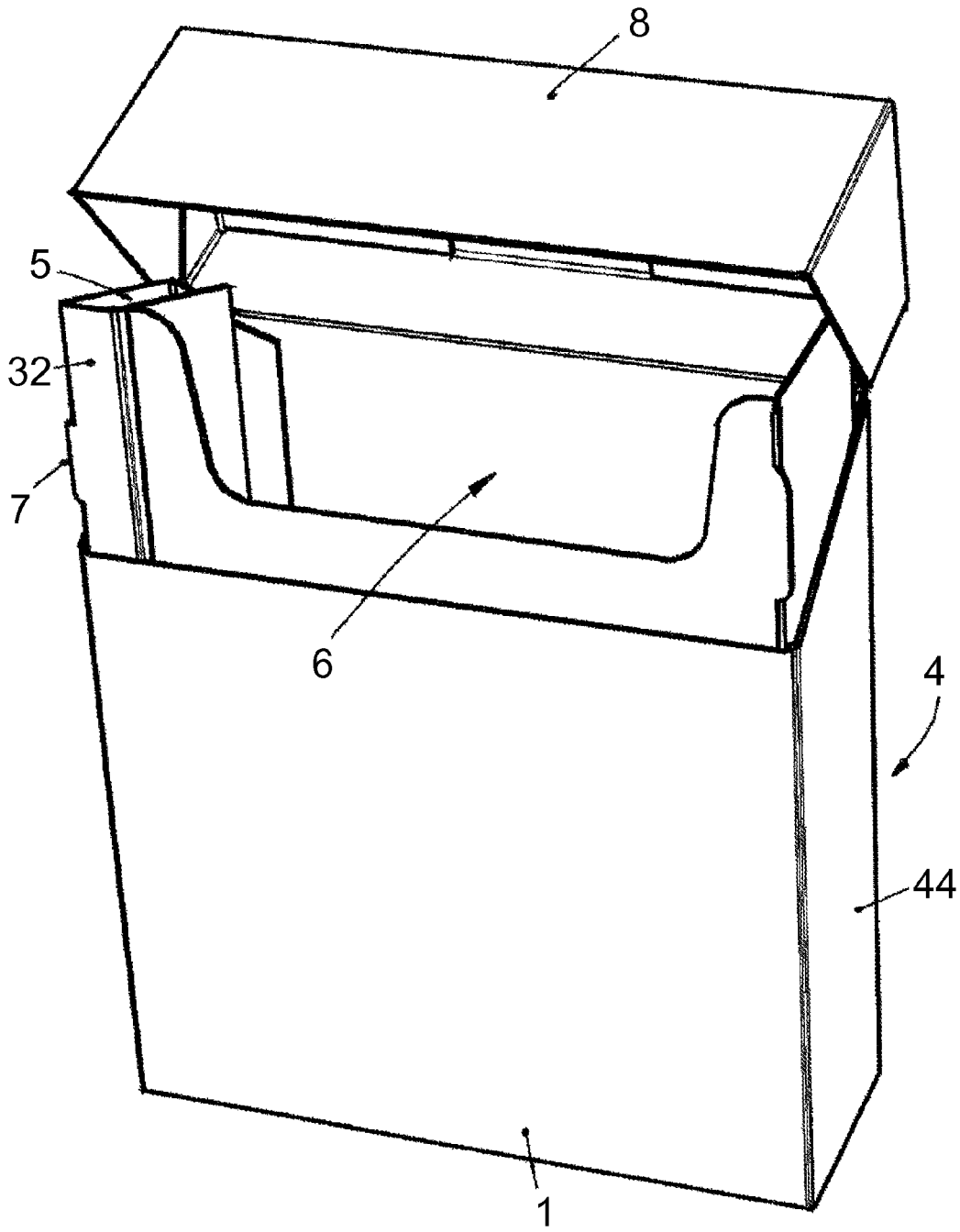

There is shown:

FIG. 1 a blank of a first embodiment of the present invention;

FIGS. 2*a* to 2*c* consecutive states of a packet in accordance with the invention during folding;

FIG. 3 a finished packet in accordance with a first embodiment;

FIG. 4 a blank of a second embodiment of the present invention;

FIG. 5 a finished packet in accordance with a second embodiment.

FIG. 1 shows a blank of a first embodiment of the present invention. The single-piece blank for a flip pack comprises a front packet side 1 and a rear packet side 2, wherein the lid 8 is connected in a joint to the rear packet side 2. The subsequent side areas 3, 4 of the packet are formed by the areas 31 and 34 and the areas 41 and 44, respectively, which come to rest on each other in the finished packet, wherein the areas 31 and 41 adjoin the rear area 2 on both sides and are situated level with it as viewed in the longitudinal direction of the blank. At the same height, the areas 32 and 33 and the areas 42 and 43, respectively, sequentially adjoin the areas 31 and 41 and—together with the areas 31 and 41 and partial regions of the rear area 2—bound the subsequent hollow spaces 5 of the packet. Flaps, which are not designated in more detail, are also formed to the left of the area 33 and to the right of the area 43, respectively, and are glued to the interior side of the rear area 2 in the finished packet, such that stable hollow spaces 5 are formed. Protrusions 7 are also shown which are formed on the folding edge between the areas 31 and 32 and the areas 41 and 42, respectively, and are intended to subsequently aid in holding the lid 8 in a closed position on the packet body.

Said blank is symmetrical, such that the subsequent packet is also symmetrical and comprises a hollow space 5 on both side areas 3 and 4.

Upon closer inspection, it is additionally noticeable that the areas 31, 32, 33, 41, 42 and 43 are longer in the longitudinal direction of the blank than the areas 34 and 44 which lie on the outside of the side areas 3 and 4 in the finished packet. Since both the areas 31, 32, 33, 41, 42 and 43 and the areas 34 and 44 extend away from the base of the packet, the former areas protrude behind the latter and extend further in the direction of the lid 8. In this way, they are able to fulfil the function of a packet frame, for which reason the protrusions 7 are also formed on them.

FIGS. 2*a* to 2*c* show different consecutive states of a packet during folding. Firstly, the areas 31, 32 and 33 and the areas 41, 42 and 43, respectively, are bent over at a right angle with respect to each other, wherein the aforementioned flaps which adjoin the areas 33 and 43 are glued to the interior side of the rear area 2. Correspondingly, hollow spaces 5 can already be seen in FIG. 2*b* which subsequently adjoin the accommodating space 6 shown in FIG. 2*c* and are delimited by the areas 33 and 43, respectively. The accommodating space 6 is bounded by the hollow spaces 5 over the entire height and additionally over the entire width of the packet, such that the packet in accordance with the invention comprises an oblong accommodating space 6 which is smaller than in conventional cigarette packets. In a method step which follows FIG. 2*c*, the front area 1 of the packet is placed onto the accommodating space 6, which is still open, and together with the areas 33 and 43, the base and the lid 8 of the packet, forms the sixth side which bounds the accommodating space 6. The interior sides of the areas 34 and 44 are consequently placed onto the exterior sides of the areas 31 and 41 and glued to them. The protrusions 7 protrude beyond the distance between the areas 31 and 41 on both sides which abut the interior sides of the side areas of the lid in the finished packet and slightly jam the lid 8 such that it can only be opened and closed by applying a certain force. This prevents the lid 8 from being unintentionally opened.

FIG. 3 shows a completely folded and glued packet which comprises hollow spaces 5 on both sides which are symmetrical and rectangular in cross-section and in which the bounding areas 31, 32 and 33 and the bounding areas 41, 42 and 43, respectively, protrude beyond the areas 34 and 44 in the direction of the lid and thus form a kind of packet frame.

FIG. 4 shows the blank of another embodiment of the present invention, namely the blank for an asymmetrical cigarette packet which only comprises a hollow space on one side area. Aside from the fact that the areas 41 to 43 which would bound a right-hand hollow space are missing in the blank, there is no difference with respect to the first embodiment.

As can be gathered from FIG. 5, the lack of a right-hand hollow space 5 necessitates a packet frame (not indicated), which provides a right-hand guiding area for the right-hand side area of the lid 8 and a protrusion which holds the lid 8 closed.

It should also be noted that the flaps of the areas which form the hollow space(s), which are to be glued to the interior side of the rear area 2, can within certain limits be glued to the rear area 2 at different positions, such that slightly trapeziform hollow spaces 5 are formed and a differing number of cigarettes and/or cigarettes of differing formats can thus be accommodated by cigarette packets made from the same blank. It would also be conceivable to fix the areas which bound the hollow spaces 5 in a way other than by gluing the flaps to the rear area 2, for example by folding the flaps over in the direction of the hollow spaces 5, such that they abut the areas 31 and 41, respectively, with an edge as the "abutment".

The invention claimed is:

1. A packet for smoking products comprising a front wall, a rear wall, and two opposing lateral walls, said front, rear and lateral walls defining an interior space of the packet, the packet further comprising a plurality of interior boundary panels defining a hollow space and a smoking product accommodating space within the interior space of the packet, wherein the hollow space is bounded by a lateral wall and an opposing interior boundary panel;

wherein the packet walls and interior panels are part of a single-piece packet blank; and wherein at least one interior boundary panel extends beyond an upper edge of a lateral wall of the packet.

2. The packet according to claim 1, wherein at least one boundary panel is configured to pivot, to allow variation of the volume of the hollow space.

3. The packet according to claim 1, wherein the hollow space extends substantially over at least one of the height and width of the corresponding lateral wall.

4. The packet according to claim 1, wherein the hollow space exhibits a substantially rectangular cross-section.

5. The packet according to claim 1, wherein the interior boundary panels define a plurality of hollow spaces within the interior space of the packet, and wherein each hollow space is bounded by its respective lateral wall and a corresponding opposing interior boundary panel.

6. The packet according to claim 5, wherein the hollow spaces are formed so as to be symmetrical with respect to each other and to exhibit area symmetry.

7. The packet according to claim 1, further comprising a protrusion configured to hold a lid of the packet in a closed position, wherein the protrusion is formed on a folding edge between two interior boundary panels.

8. A packet for cigarettes comprising:

a front wall, a rear wall, a base, a lid, and two opposing lateral walls defining a first cigarette-accommodating volume; and a plurality of pivotable interior boundary walls located within said cigarette-accommodating volume, wherein said interior boundary walls define interior hollow spaces which serve to reduce the cigarette-accommodating volume;

wherein the interior boundary walls are part of a single-piece packet blank; and wherein at least one of the interior boundary walls extends beyond an upper edge of a lateral wall of the packet.

9. The packet of claim 8, wherein at least one of the interior hollow spaces is positioned adjacent to a lateral wall.

10. The packet of claim 8, wherein at least one of the pivotable interior boundary walls extends substantially over a lateral wall, creating a double wall.

11. A packet for cigarettes comprising:

a front wall, a rear wall, a base, a lid, and two opposing lateral walls defining a first cigarette-accommodating volume; and a plurality of pivotable interior boundary walls located within said cigarette-accommodating volume, wherein said interior boundary walls define interior pockets which serve to subdivide the cigarette-accommodating volume;

wherein the interior boundary walls are part of a single-piece packet blank; and wherein at least one of the interior boundary walls extends beyond an upper edge of a lateral wall of the packet.

12. The packet of claim 11, wherein at least one of the interior pockets is positioned adjacent to a lateral wall.

13. The packet of claim 11, wherein at least one of the pivotable interior boundary walls extends substantially over one of the lateral walls, creating a double wall.

14. A single-piece blank for manufacturing a packet comprising:

a body front panel;

a body rear panel;

a lid portion;

a base portion;

a plurality of opposing side portions; and a plurality of pocket-defining portions;

wherein the lid portion adjoins the body rear panel;

wherein the pocket-defining portions adjoin the body rear panel;

wherein at least one pocket-defining portion includes a flap for securing to the body rear panel; and wherein at least one of the pocket-defining portions is configured to extend beyond an upper edge of a side portion when the blank is folded into a packet.

15. The blank according to claim 14, wherein the pocket-defining portions are arranged adjacent to the body rear panel.

* * * * *

UNITED STATES PATENT AND TRADEMARK OFFICE

CERTIFICATE OF CORRECTION

PATENT NO. : 8,763,800 B2
APPLICATION NO. : 13/820112
DATED : July 1, 2014
INVENTOR(S) : Erdinc Agirbas It is certified that error appears in the above-identified patent and that said Letters Patent is hereby corrected as shown below:

On the title page:

Item (30) Foreign Application Priority Data

"10 2010 035 938" should read --10 2010 035 938.6--

Signed and Sealed this
Twenty-eighth Day of October, 2014

Michelle K. Lee

Michelle K. Lee
*Deputy Director of the United States Patent and Trademark Office*